US005176061A

United States Patent [19]

Mano

[11] Patent Number: 5,176,061

[45] Date of Patent: Jan. 5, 1993

[54] BLANKING CUTTER

[75] Inventor: Teruo Mano, Saitama, Japan

[73] Assignee: Dumbbell Co., Ltd., Saitama, Japan

[21] Appl. No.: 917,911

[22] Filed: Jul. 21, 1992

Related U.S. Application Data

[63] Continuation of Ser. No. 654,315, Feb. 12, 1991, abandoned.

[51] Int. Cl.[5] ..... B26F 1/44

[52] U.S. Cl. ..... 83/684; 83/128; 83/698

[58] Field of Search ..... 83/125, 128, 140, 143, 83/684, 685, 686, 689, 698

[56] References Cited

U.S. PATENT DOCUMENTS

| | | | |
|---|---|---|---|
| 1,082,985 | 12/1913 | Wilder et al. | 83/55 |
| 3,091,986 | 6/1963 | Tracey et al. | 83/685 |
| 3,227,024 | 1/1966 | Krebs | 83/568 |
| 3,721,144 | 3/1973 | Yamamori | 83/689 |
| 4,610,650 | 9/1986 | Piggott | 83/566 |

*Primary Examiner*—Hien H. Phan

*Attorney, Agent, or Firm*—Robert W. J. Usher

[57] ABSTRACT

A blanking cutter cuts out a dumbbell-shaped test piece from a sheet of rubber, plastic, vinyl, polyethylene, paper, or the like. The dumbbell-shaped test piece has wider opposite ends and a narrower intermediate strip portion joined thereto along curves. The blanking cutter has a base, a plurality of flexible shearing blades, and a plurality of presser plates which clamp the shearing blades against the sides of the base. The shearing blades fully surround the outer profile of the base and have respective cutting edges projecting beyond the base and the presser plates. The sides of the outer profile of the base which correspond to the intermediate strip portion of the dumbbell-shaped test piece, and the sides of the presser plate which are held intimately against those sides of the base with the corresponding shearing blades clamped therebetween, comprise concave surfaces having respective radii of curvature which are greater than the radii of curvature of the curves along which the opposite ends and intermediate strip portion of the dumbbell-shaped test piece are joined to each other.

5 Claims, 5 Drawing Sheets

BLANKING CUTTER

This is a continuation of application Ser. No. 07/654,315 filed Feb. 12, 1991 now abandoned.

BACKGROUND OF THE INVENTION

The present invention relates to a blanking cutter for punching out a dumbbell-shaped test piece from a sheet of rubber, plastic, vinyl, polyethylene, paper, or the like.

Various materials such as rubber, plastic, vinyl, polyethylene, paper, etc. are tested for mechanical strength using a dumbbell-shaped test piece of such a material, as shown in FIG. 7 of the accompanying drawings. The dumbbell-shaped test piece has widened opposite ends 2 each having a width B1 and an intermediate narrower strip portion 3 having a width B2. The opposite ends 2 have lateral sides smoothly joined along sine curves to the lateral sides of the intermediate strip portion 3 via convex curves 4*a* having a radius of curvature r1 and concave curves 4*b*having a radius of curvature r2. The shape and dimensions of such a dumbbell-shaped test piece are specified in detail according to various industrial standards including JIS (Japan), DIN (Germany), and ASTM (U.S.A.).

Heretofore, dumbbell-shaped test pieces are cut out of a sheet by a forged blanking cutter 5 as shown in FIG. 11. The blanking cutter 5 has an upper edge 6 forged to a shape complementary to the shape of a dumbbell-shaped test piece to be blanked. The upper edge 6 is sharpened by a grinder or the like into a shearing blade, which is subsequently heat-treated for desired hardness. The shearing blade is however relatively low in dimensional accuracy because it is sharpened manually by the grinder. If the shearing blade is broken or damaged, it is necessary to replace the entire blanking cutter 5, which is not economical.

In view of the above drawback, the applicant has proposed a blanking Cutter 100 with replaceable shearing blades, as shown in FIGS. 8 through 10 (see Japanese Laid-Open Patent Publication No. 54(1949)-60389).

The blanking cutter 100 comprises a base 101 having a shape complementary to the shape of a dumbbell-shaped test piece to be blanked, four presser plates 102*a*, 102*b*, 103*a*, 103*b* fastened intimately to the respective four sides of the base 101, four shearing blades 105*a*, 105*b*, 106*a*, 106*b* clamped between the base 101 and the respective presser plates 102*a*, 102*b*, 103*a*, 103*b*, and a grip boss 107 joined to an upper surface of the base 101. Each of the shearing blades 105*a*, 105*b*, 106*a*, 106*b* is in the form of a thin plate having a thickness of 0.3 mm, for example, and is so flexible that the shearing blades 105*a*, 105*b* can intimately be held against the curved lateral sides of the base 101 by the presser plates 102*a*, 102*b*. The shearing blades 105*a*, 105*b*, 106*a*, 106*b* have lengths equal to the extended lengths of the corresponding four sides of the base 101. The shearing blades 105*a*, 105*b*, 106*a*, 106*b* pressed by the respective presser plates 102*a*, 102*b*, 106*a*, 106*b* and fastened to the base 1 have respective cutting edges projecting downwardly of the base 101 and the presser plates 102*a*, 102*b*, 103*a*, 103*b*.

The blanking cutter 100 is attached to a press by the grip boss 107. Then, the blanking cutter 100 is held against a sheet, and forced into the sheet by the press, thereby cutting out a dumbbell-shaped test piece from the sheet.

It has been found that the cutting edges of the shearing blades 105*a*, 105*b* for defining the curved sides of a dumbbell-shaped test piece tend to be deflected inwardly as indicated by the two-dot-and-dash lines A in FIG. 9. The deflected shearing blades 105*a*, 105*b* are shown exaggerated for illustrative purpose, and the actual amount of deflection of the shearing blades 105*a*, 105*b* is smaller. Since dumbbell-shaped test pieces are required to have high dimensional accuracy, if the shearing blades 105*a*, 105*b* are deflected as shown in FIG. 9, it is difficult to produce dumbbell-shaped test pieces which meet desired accuracy requirements. If a dumbbell-shaped test piece 1 (FIG. 1) were produced by the blanking cutter 100 with deflected shearing blades, then the width B2 of the intermediate strip portion 3 and the shape of the curves 4*a*, 4*b* would be subjected to error. Any material test using such a dumbbell-shaped test piece 1 with dimensional errors would be unable to achieve proper results.

SUMMARY OF THE INVENTION

It is an object of the present invention to provide a blanking cutter with replaceable shearing blades, which is capable of cutting out dumbbell-shaped test pieces with high dimensional accuracy.

Another object of the present invention is to provide a blanking cutter which includes shearing blades for defining curved sides of a dumbbell-shaped test piece, the shearing blades being prevented from being deflected inwardly.

According to the present invention there is provided a blanking cutter for cutting out a dumbbell-shaped test piece having wider opposite ends and a narrower intermediate strip portion joined thereto along curves, from a sheet, comprising a base complementary in shape to the dumbbell-shaped test piece and having an outer profile composed of a plurality of sides, a plurality of flexible shearing blades having respective lengths equal to extended lengths of the respective sides of the outer profile of the base, and a plurality of presser plates having sides held intimately against the sides, respectively, of the base with the shearing blades clamped therebetween, thereby attaching the shearing blades to the sides of the base, the shearing blades fully surrounding the outer profile of the base and having respective cutting edges projecting beyond the base and the presser plates, the sides of the outer profile of the base which correspond to the intermediate strip portion of the dumbbell-shaped test piece, and the sides of the presser plate which are held intimately against those sides of the base with the corresponding shearing blades clamped therebetween, comprising concave surfaces having respective radii of curvature which are greater than the radii of curvature of the curves along which the opposite ends and intermediate strip portion of the dumbbell-shaped test piece are joined to each other.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
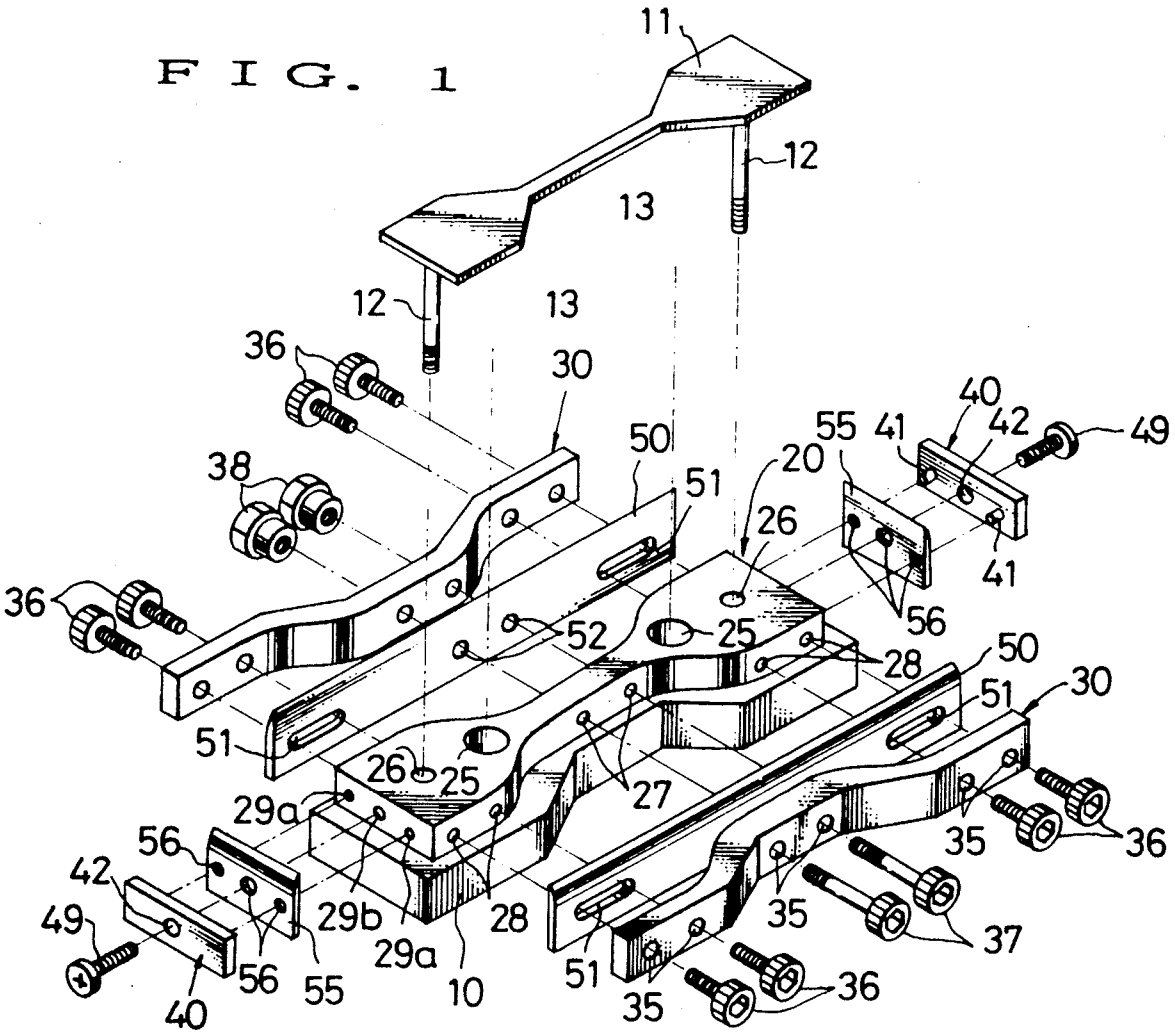
FIG. 1 is an exploded perspective view of a blanking cutter according to the present invention.
Figure 2:
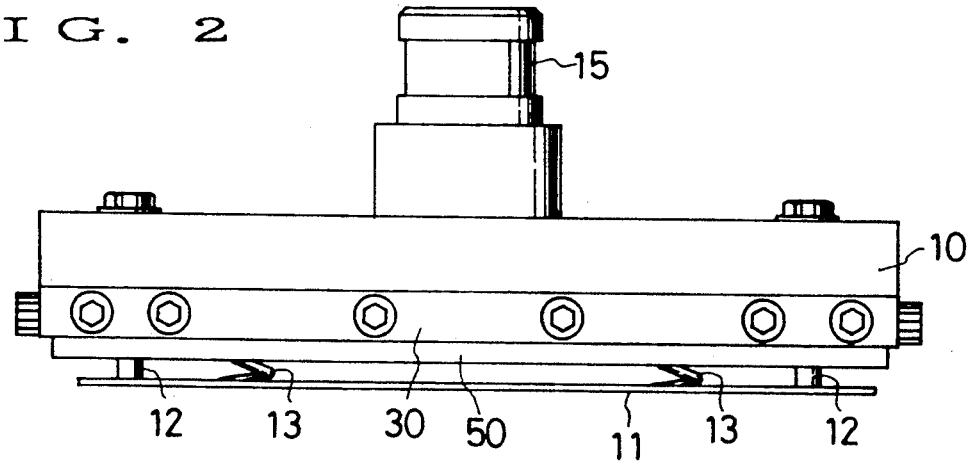
FIG. 2 is a front elevational view of the blanking cutter according to the present invention.
Figure 3:
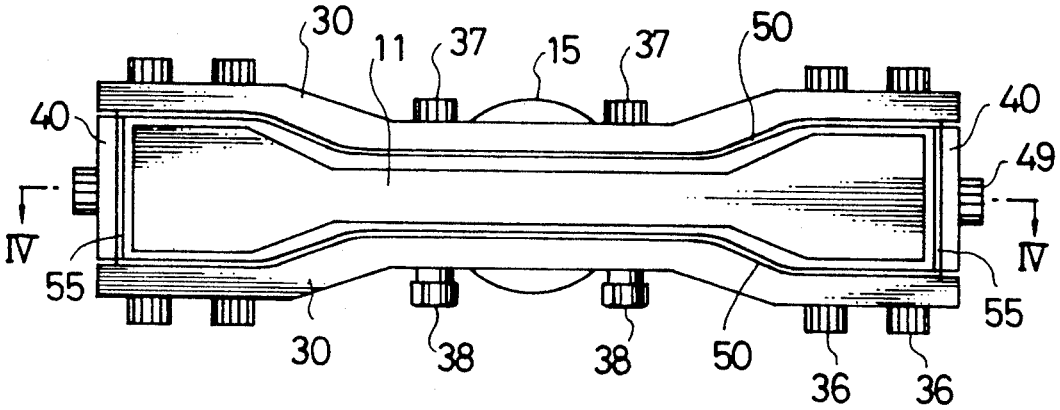
FIG. 3 is a bottom view of the blanking cutter shown in FIG. 2.
Figure 4:
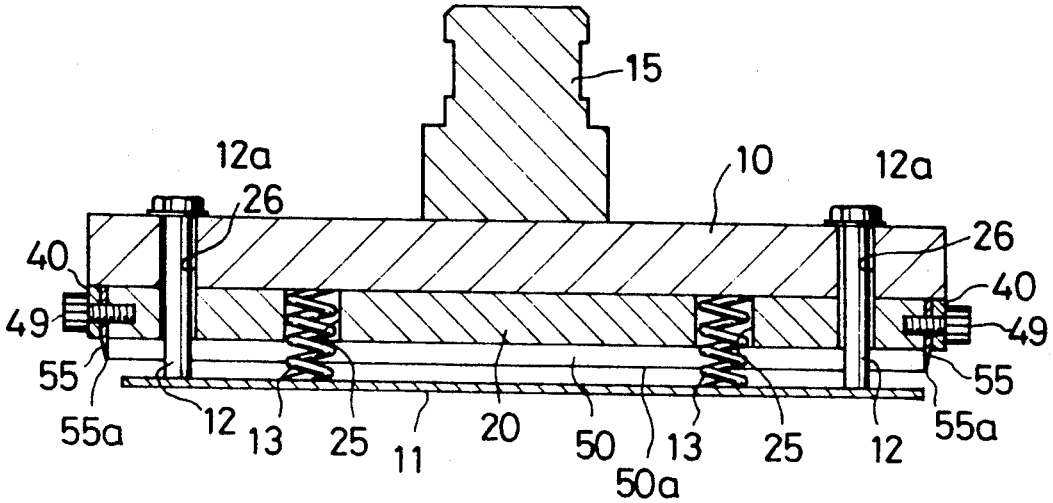
FIG. 4 is a cross-sectional view taken along line IV—IV of FIG. 3.

FIG. 1 shows a blanking cutter in exploded perspective, the blanking cutter being shown upside down. The blanking cutter comprises a support plate 10, a base 20 joined to the support plate 10, four shearing blades 50, 55 attached respectively to four sides of the base 20, four presser plates 30, 40 for pressing the shearing blades 50, 55 to the respective sides of the base 20, and a knockout plate 11 for pushing out a blanked test piece. The shearing blades 50, 55, and the presser plates 30, 40 are fastened to the base 20 by bolts 36, 37, 49 and nuts 38, as shown in FIGS. 2 through 4.

Figure 5:
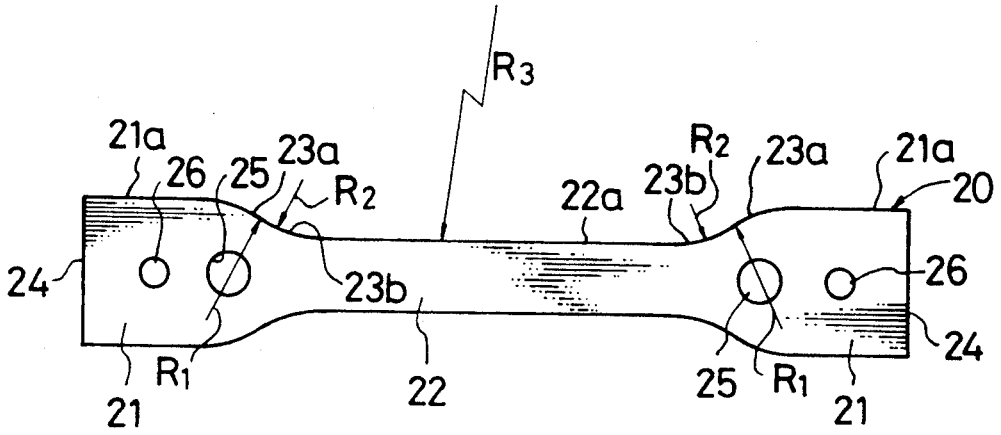
FIG. 5 is a plan view of a base of the blanking cutter according to the present invention.

As shown in FIG. 5, the base 20 is complementary in shape to a dumbbell-shaped test piece to be blanked by the blanking cutter, and comprises two wider opposite ends 21 and an intermediate narrower strip portion 22. The base 22 is joined to the lower surface of the support plate 10. A grip boss 15 is joined to the upper surface of the support plate 10. The support plate 10 and the base 20 jointly have two vertical through hoes 26 positioned in the respective ends 21. Studs 12 with lower ends joined to the knockout plate 11 are inserted, from below, into the respective through holes 26. Nuts 12*a* are threaded over respective upper ends of the studs 12, such that the knockout plate 11 is attached for vertical movement with respect to the support plate 10 and the base 20. The base 20 also has two spring holes 25 defined therein. Before the knockout plate 11 is attached, knockout springs 13 are placed respectively in the spring holes 25 and held against the knockout plate 11. As shown in FIG. 4, the knockout plate 11 is pushed downwardly under the bias of the knockout springs 13 with the nuts 12 on the upper ends of the studs 12 being held in abutment against the upper surface of the support plate 10.

The base 20 has an outer profile including two longitudinal opposite sides 24 having flat surfaces at the respective wider ends 21. The shearing blades 55, which are shorter than the shearing blades 50, are of the same length as the sides 24. The shearing blades 55 are clamped against the respective sides 24 by the presser plates 40. Each of the presser plates 40 has two positioning pins 41 and a bolt hole 42 defined between the positioning pins 41. Each of the shorter shearing blades 55 has three holes 56 for insertion of the positioning pins 41 and a bolt 49. The positioning pins 41 are inserted through the holes 56 into holes 29*a* in the sides 24 of the base 20, and the shorter shearing blades 55 are held against the respective sides of the base 20 by the presser plates 40. Then, the bolts 49 are threaded through the holes 42, 56 into threaded holes 29*b* defined in the sides 24 of the base 20, thereby fastening the shorter shearing blades 55 to the respective sides 24. Each of the shorter shearing blades 55 is in the form of a stainless steel plate having a thickness of 0.3 mm, and has a cutting edge 55*a* directed downwardly and projecting below the lower surfaces of the base 20 and the presser plates 40.

The outer profile of the base 20 also includes two transverse opposite sides each composed of a first flat surface 21*a* serving as a lateral side of one of the wider ends 21, a second surface 22*a* serving as a lateral side of the intermediate strip portion 22, two convex surfaces 23*a* and two curved surfaces 23*b* which join the first and second surfaces 21*a*, 22*a*. The convex surfaces 23*a* have a radius of curvature R1 and the concave surfaces 23*b* have a radius of curvature R2. The second side surfaces 22*a* correspond to the lateral sides of the intermediate strip portion of a dumbbell-shaped test piece. The second side surfaces 22*a* comprise concave surfaces having a very large radius of curvature R3.

Figure 6:
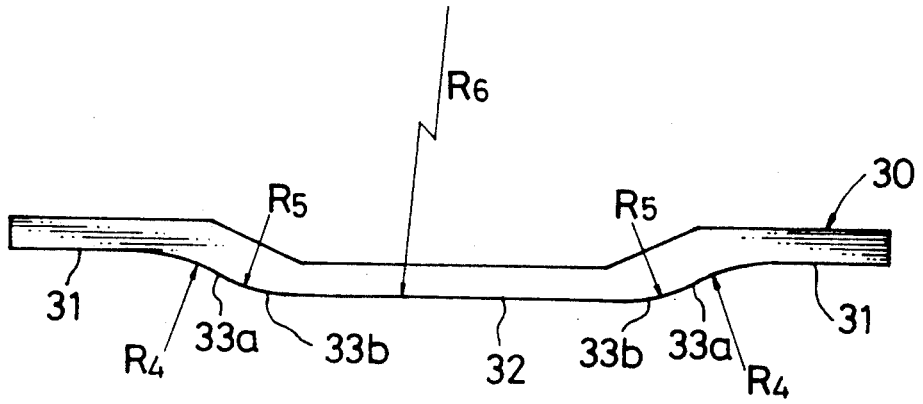
FIG. 6 is a plan view of a presser plate of the blanking cutter according to the present invention.
Figure 7:
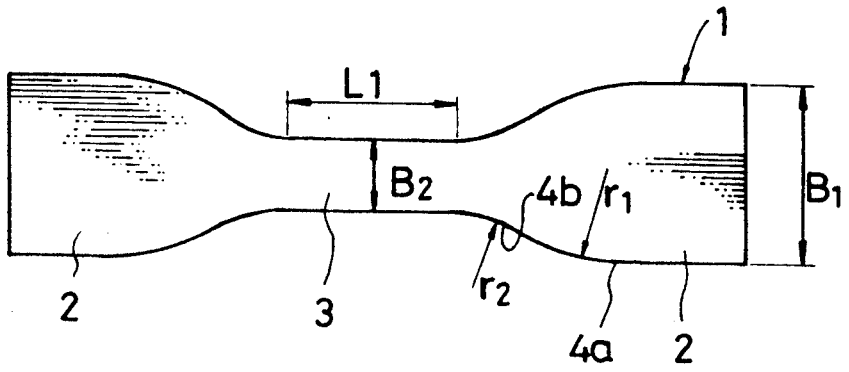
FIG. 7 is a plan view of a dumbbell-shaped test piece.
Figure 8:
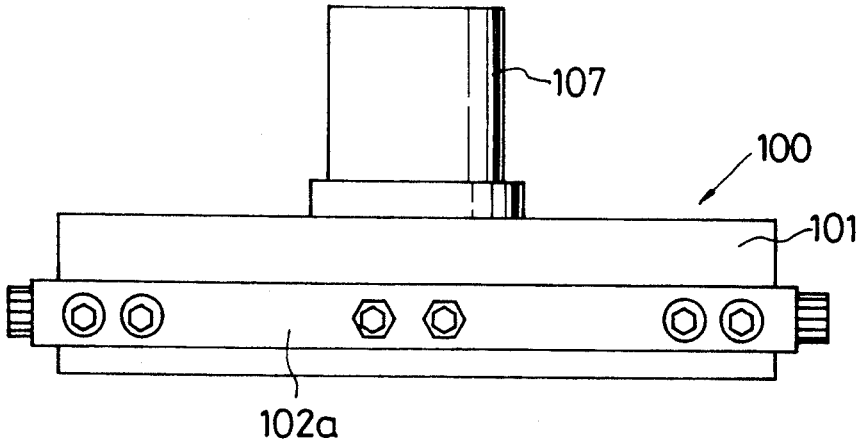
FIG. 8 PRIOR ART
FIG. 8 is a front elevational view of a conventional blanking cutter.

The longer shearing blades 55, which are in the form of thin flexible plates, have the same length as the extended transverse opposite sides of the base 20, and are intimately attached respectively to the transverse opposite sides of the base 20 by the respective presser plates 30. As shown in FIG. 6, each of the presser plates 30 is of a complementary shape for holding the longer shearing blade 50 intimately against the transverse side of the base 20. Each presser plate 30 comprises two first side surfaces 31 for mating with the first side surfaces 21*a*, respectively, of the base 20, a second side surface 32 for mating with the second side surface 22*a* of the base 20, two concave surfaces 33*a* for mating with the respective convex surfaces 23*a* of the base 20, and two convex surfaces 33*b* for mating with the respective concave surfaces 23*b* of the base 20. The concave surfaces 33*a* have a radius of curvature R4 and the convex surfaces 33*b* have a radius of curvature R5. The second side surface 32 corresponds to the second side surface 22*a* of the base 20, and comprises a convex surface having a very large radius of curvature R6 which is substantially the same as the radius of curvature R3.

The presser plates 30 are held against the lateral sides of the base 20 with the longer shearing blades 50 clamped therebetween, and fastened in place by the bolts 36, 37 and the nuts 38. The presser plates 30 and the longer shearing blades 50 have bolt holes 35, 51, 52 through which the bolts 36, 37 are inserted, and the base 20 has through holes 37 through which the bolts 37 extend and threaded holes 28 into which the bolts 36 are threaded.

Figure 9:
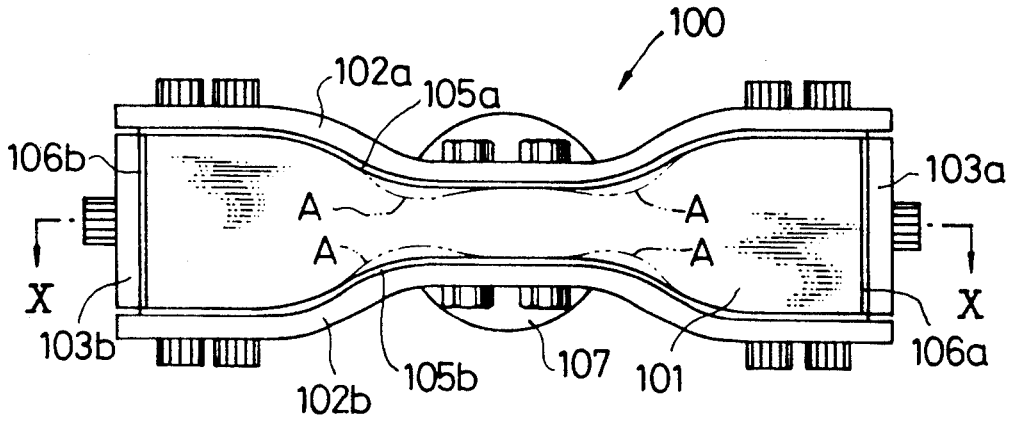
FIG. 9 PRIOR ART
FIG. 9 is a bottom view of the conventional blanking cutter shown in FIG. 8.
Figure 10:
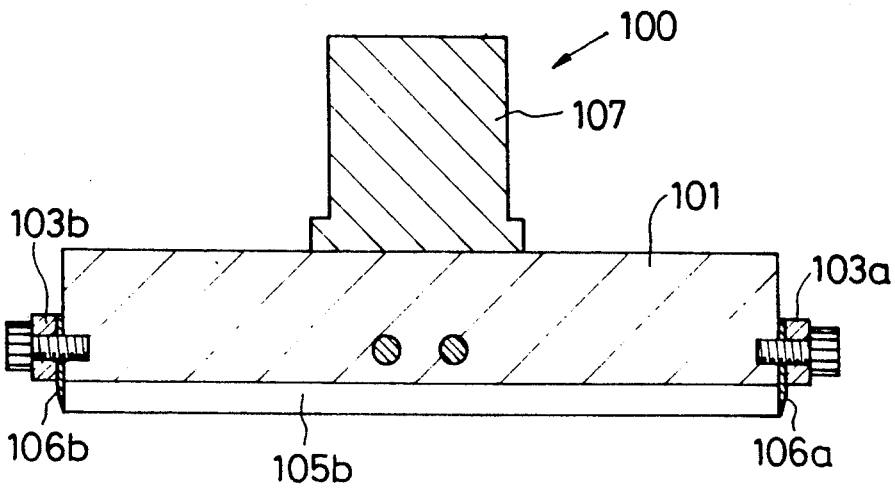
FIG. 10 PRIOR ART
FIG. 10 is a cross-sectional view taken along line X—X of FIG. 9.
Figure 11:
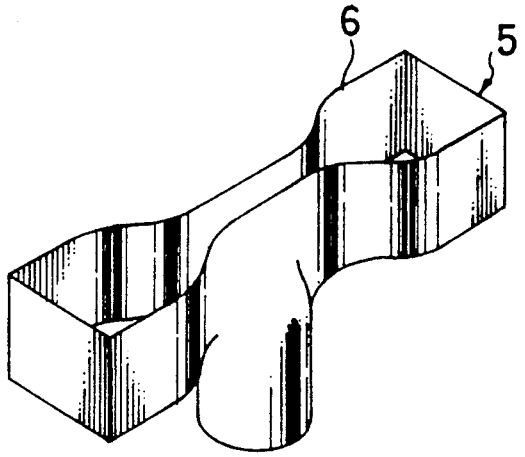
FIG. 11 PRIOR ART
FIG. 11 is a perspective view of another conventional blanking cutter.

Each of the longer shearing blades 50 comprises a stainless steel plate having a thickness of 0.2 mm. Since the longer shearing blades 50 are flexible, they are elastically deformed and intimately held against the lateral sides of the base 20 when pressed by the presser plates 30. Since the second side surfaces 22*a* of the base 20 are concave surfaces with the radius of curvature R3 and the second side surfaces 32 of the presser plates 30 are convex surfaces with the radius of curvature R6, the cutting edges 50*a* of the shearing blades 50 clamped between these second side surfaces 22*a*, 32 are prevented from being deflected inwardly, unlike the conventional arrangement shown in FIG. 9.

The radii of curvature R3, R6 are selected to prevent the cutting edges 50*a* from being deflected inwardly. The radii of curvature R3, R6 are affected by the radius of curvature r1 of the convex surfaces 4a and the radius of curvature r2 of the concave surfaces 4b of the dumbbell-shaped test piece 1, the thickness of the longer shearing blades 50, the difference between the width B1 of the wider ends 2 and the width B2 of the intermediate portion 3 of the dumbbell-shaped test piece 1, and the length L of the intermediate portion 3 thereof. Therefore, the radii of curvature R3, R6 are experimentally established for each blanking cutter design.

Specific examples will be described below.

EXAMPLE 1

If the thickness of the longer shearing blades 50 is 0.2 mm, the radius of curvature r1 of the convex surfaces 4a of the dumbbell-shaped test piece 1 is 25 mm, the radius of curvature r2 of the concave surfaces 4b thereof is 14 mm, the width B1 of the wider ends 2 is 25 mm, the width B2 of the intermediate portion 3 is 12 mm, and the length L1 thereof is 60 mm, then the radius of curvature R3 of the concave second side surfaces 22a of the base 20 is 3600 mm, and the radius of curvature R6 of the convex second side surfaces 32 of the presser plates 30 is 3599.8 mm.

EXAMPLE 2

If the thickness of the longer shearing blades 50 is 0.3 mm, the radius of curvature r1 of the convex surfaces 4a of the dumbbell-shaped test piece 1 is 25 mm, the radius of curvature r2 of the concave surfaces 4b thereof is 14 mm, the width B1 of the wider ends 2 is 19 mm, the width B2 of the intermediate portion 3 is 6 mm, and the length L1 thereof is 33 mm, then the radius of curvature R3 of the concave second side surfaces 22a of the base 20 is 1360 mm, and the radius of curvature R6 of the convex second side surfaces 32 of the presser plates 30 is 1359.8 mm.

Because the radii of curvature R3, R6 are governed by the other dimensions described above, they cannot uniquely be established in advance, but have to be determined for each blanking cutter design. Generally, however, the radii of curvature R3, R6 tend to become greater as the radii of curvature r1, r2 of the convex and concave surfaces 4a, 4b are greater, the difference between the widths B1, B2 is smaller, and the length L1 is larger.

The blanking cutter thus constructed is used as follows: The blanking cutter is attached to a press by the grip boss 15. Then, the blanking cutter is held against a sheet of rubber, plastic, vinyl, polyethylene, paper, or the like, and forced into the sheet by the press, thereby causing the cutting edges of the shearing blades 50, 55 to cut out a dumbbell-shaped test piece from the sheet. At this time, the knockout plate 11 which is vertically movable is pushed upwardly beyond the cutting edges. When the blanking cutter is subsequently lifted, the knockout plate 11 is pressed downwardly by the knockout springs 13, pushing the blanked test piece off shearing blades 50, 55.

Although a certain preferred embodiment has been shown and described, it should be understood that many changes and modifications may be made therein without departing from the scope of the appended claims.

What is claimed is:

1. A blanking cutter for cutting out, from a sheet, a dumbbell-shaped blank test piece having wider opposite end portions and a narrower, substantially straight-sided, intermediate strip portion joined thereto along concavely and then convexly curved side portions, and comprising:

a base with wider opposite end portions and a narrower, intermediate strip portion providing an outer profile corresponding in shape to the dumbbell-shaped test piece and formed by opposite longitudinal sides and opposite lateral sides, the longitudinal sides having intermediate, substantially straight portions joining concavely and then convexly curved portions;

a plurality of thin, flat flexible shearing blades having respective lengths at least equal to perimetrical lengths of opposite sides of said base;

a plurality of presser plates having side portions of complementary shapes to the respective sides of the base and held intimately against the respective sides of the base with the shearing blades clamped therebetween, thereby attaching said shearing blades to the sides of said base;

said shearing blades surrounding fully the outer profile of said base and having respective cutting edges projecting beyond said base and said presser plates;

wherein the improvement resides in that the intermediate, substantially straight portions of the longitudinal sides of said base which correspond to the substantially straight sided intermediate strip portion of the dumbbell-shaped test piece each comprises a concave surface having a large radius of curvature, and said portions of the sides of said presser plates which are of complementary shape to the intermediate portions of the longitudinal sides of the base and which are held intimately thereagainst with the corresponding shearing blades clamped therebetween, each comprises a convex surface, and portions of said presser plates having large radii of curvature complementary to the respective concave surface of the intermediate portion of the base so as to prevent the projecting cutting edges of said blades which extend along the longitudinal sides of said base from being deflected inwardly, towards each other, out of alignment with the outer profile formed by the intermediate portions of the longitudinal sides of said base.

2. A blanking cutter according to claim 1, wherein said radii of curvature of said concave surfaces increase with increasing thickness of said shearing blades.

3. A blanking cutter according to claim 1, wherein said radii of curvature of said concave surface increase with increasing radii of curvature of the curved portions along which opposite ends and intermediate strip portions of the base are joined.

4. A blanking cutter according to claim 1, wherein said radii of curvature of said concave surfaces increase with a decreasing difference between the width of the opposite ends of the base and the width of the intermediate strip portion of the base.

5. A blanking cutter according to claim 1, wherein the radii of curvature of said concave surfaces increase with increasing length of the intermediate strip portion of the base.

* * * * *